US011761737B2

(12) United States Patent
Cerovic et al.

(10) Patent No.: US 11,761,737 B2
(45) Date of Patent: Sep. 19, 2023

(54) PROJECTILE LAUNCHING SYSTEMS WITH ANCHORS HAVING DISSIMILAR FLIGHT CHARACTERISTICS

(71) Applicant: Wrap Technologies, Inc., Tempe, AZ (US)

(72) Inventors: Milan Cerovic, Tempe, AZ (US); David T. Richter, Tempe, AZ (US); Andrew Chiang, Tempe, AZ (US); Elwood G. Norris, Poway, CA (US)

(73) Assignee: Wrap Technologies, Inc., Tempe, AZ (US)

( * ) Notice: Subject to any disclaimer, the term of this patent is extended or adjusted under 35 U.S.C. 154(b) by 0 days.

(21) Appl. No.: 17/506,402

(22) Filed: Oct. 20, 2021

(65) Prior Publication Data

US 2022/0260346 A1 Aug. 18, 2022

Related U.S. Application Data

(63) Continuation-in-part of application No. 17/179,341, filed on Feb. 18, 2021, now Pat. No. 11,555,673.

(51) Int. Cl.
*F42B 12/66* (2006.01)
*F41H 13/00* (2006.01)

(52) U.S. Cl.
CPC ..... *F41H 13/0006* (2013.01); *F42B 12/66* (2013.01)

(58) Field of Classification Search
CPC ..... F41H 13/0006; F41B 11/80; F41B 15/10; F42B 6/00; F42B 10/10; F42B 10/32; F42B 12/66
See application file for complete search history.

(56) References Cited

U.S. PATENT DOCUMENTS

| | | | |
|---|---|---|---|
| 34,626 | A | 3/1862 | Ely |
| 34,628 | A | 3/1862 | Gault |
| 35,734 | A | 6/1862 | Gault |
| 39,282 | A | 7/1863 | Ganster |
| 271,825 | A | 2/1883 | Fiske |
| 347,988 | A | 8/1886 | Boyd |
| 495,505 | A | 4/1893 | Martin |
| 495,506 | A | 4/1893 | Meyrowitz |
| 1,070,582 | A | 8/1913 | Browning |
| 1,151,070 | A | 8/1915 | Victory |

(Continued)

FOREIGN PATENT DOCUMENTS

| | | | |
|---|---|---|---|
| CA | 2162221 | A1 | 5/1996 |
| CN | 104085851 | A | 10/2014 |

(Continued)

*Primary Examiner* — J. Woodrow Eldred
(74) *Attorney, Agent, or Firm* — Jason R. Jones

(57) ABSTRACT

A projectile deployment system includes a projectile casing having a pair of sockets, each socket sized to carry one of a pair of anchors of an entangling projectile having a tether connecting the pair of anchors. Each of the pair of sockets is angled equally relative to a centerline defined between the sockets. One or more pressure sources is capable of generating a pressure wave capable of expelling one or more of the anchors from the sockets to deploy the entangling projectile from the projectile casing toward a subject. A controller is operable to activate one or both of the pressure sources. A sight is oriented along a target line, the target line being offset relative to the centerline defined between the sockets such that when the anchors are deployed from the projectile casing they exhibit differing flight characteristics.

13 Claims, 10 Drawing Sheets

(56) References Cited

U.S. PATENT DOCUMENTS

| | | | |
|---|---|---|---|
| 1,165,053 | A | 12/1915 | Wodiska |
| 1,198,035 | A | 9/1916 | Huntington |
| 1,211,001 | A | 1/1917 | Steinmetz |
| 1,217,415 | A | 2/1917 | Colomyjczuk |
| 1,229,421 | A | 6/1917 | Downs |
| 1,276,689 | A | 8/1918 | Poudrier |
| 1,304,857 | A | 5/1919 | Davis |
| 1,343,747 | A | 6/1920 | Radakovich |
| 1,488,182 | A | 3/1924 | Whelton |
| 1,536,164 | A | 5/1925 | Tainton |
| 2,354,451 | A | 7/1944 | Forbes |
| 2,368,587 | A | 1/1945 | Wise |
| 2,372,383 | A | 3/1945 | Lee |
| 2,373,363 | A | 4/1945 | Wellcome |
| 2,373,364 | A | 4/1945 | Wellcome |
| 2,455,784 | A | 12/1948 | Lapsensohn |
| 2,611,340 | A | 8/1952 | Manning |
| 2,668,499 | A | 2/1954 | Mourlaque |
| 2,797,924 | A | 7/1957 | Stewart |
| 2,848,834 | A | 8/1958 | Cox |
| 2,873,974 | A | 2/1959 | Ramsey |
| 3,085,510 | A | 4/1963 | Campbell |
| 3,340,642 | A | 9/1967 | Vasiljevic |
| 3,484,665 | A | 12/1969 | Mountjoy et al. |
| 3,523,538 | A | 8/1970 | Shimizu |
| 3,583,087 | A | 6/1971 | Huebner |
| 3,717,348 | A | 2/1973 | Bowers et al. |
| 3,773,026 | A | 11/1973 | Romero |
| 3,803,463 | A | 4/1974 | Cover |
| 3,831,306 | A | 8/1974 | Gregg |
| 3,921,614 | A | 11/1975 | Fogelgren |
| 4,027,418 | A | 6/1977 | Baldi et al. |
| 4,166,619 | A | 9/1979 | Bergmann et al. |
| 4,193,386 | A | 3/1980 | Rossi |
| 4,253,132 | A | 2/1981 | Cover |
| 4,318,389 | A | 3/1982 | Kiss, Jr. |
| 4,466,417 | A | 8/1984 | Mulot et al. |
| 4,559,737 | A | 12/1985 | Washington |
| 4,615,529 | A | 10/1986 | Vocal |
| 4,656,947 | A | 4/1987 | Gordon et al. |
| 4,664,034 | A | 5/1987 | Christian |
| 4,750,692 | A | 6/1988 | Howard |
| 4,752,539 | A | 6/1988 | Vatter |
| 4,795,165 | A | 1/1989 | Tehan |
| 4,912,867 | A | 4/1990 | Dukes, Jr. |
| 4,912,869 | A | 4/1990 | Govett |
| 4,947,764 | A | 8/1990 | Rohr |
| 4,955,050 | A | 9/1990 | Yamauchi |
| 4,962,747 | A | 10/1990 | Biller |
| 5,003,886 | A | 4/1991 | Pahnke et al. |
| 5,078,117 | A | 1/1992 | Cover |
| 5,103,366 | A | 4/1992 | Battochi |
| 5,145,187 | A | 9/1992 | Lewis |
| 5,193,031 | A | 3/1993 | Baikrich |
| 5,279,482 | A | 1/1994 | Dzenitis et al. |
| 5,314,196 | A | 5/1994 | Ruelle |
| 5,315,932 | A | 5/1994 | Bertram |
| 5,326,101 | A | 7/1994 | Fay |
| 5,372,118 | A | 12/1994 | Schmidt, III et al. |
| 5,396,830 | A | 3/1995 | Kornblith et al. |
| 5,460,155 | A | 10/1995 | Hobbs, II |
| 5,546,863 | A | 8/1996 | Joslyn |
| 5,561,263 | A | 10/1996 | Baillod |
| 5,649,466 | A | 7/1997 | Genovese |
| 5,654,867 | A | 8/1997 | Murray |
| 5,671,561 | A | 9/1997 | Johnson et al. |
| 5,698,815 | A | 12/1997 | Ragner |
| 5,706,795 | A | 1/1998 | Gerwig |
| 5,735,070 | A | 4/1998 | Vasquez |
| 5,750,918 | A | 5/1998 | Mangolds et al. |
| 5,782,002 | A | 7/1998 | Reed |
| 5,786,546 | A | 7/1998 | Simson |
| 5,814,753 | A | 8/1998 | Rieger |
| 5,831,199 | A | 11/1998 | McNulty, Jr. et al. |
| 5,898,125 | A | 4/1999 | Mangolds et al. |
| 5,904,132 | A | 5/1999 | Biller |
| 5,943,806 | A | 8/1999 | Underwood |
| 5,962,806 | A | 10/1999 | Coakley et al. |
| 5,996,504 | A | 12/1999 | Lowery |
| 6,219,959 | B1 | 4/2001 | Hsieh |
| 6,283,037 | B1 | 9/2001 | Sciafani |
| 6,381,894 | B1 | 5/2002 | Murphy |
| 6,382,071 | B1 | 5/2002 | Bertani |
| 6,543,173 | B1 | 4/2003 | Golan |
| 6,575,073 | B2 | 6/2003 | McNulty, Jr. et al. |
| 6,615,622 | B2 | 9/2003 | MacAleese et al. |
| 6,636,412 | B2 | 10/2003 | Smith |
| 6,729,222 | B2 | 5/2004 | McNulty, Jr. |
| 6,820,560 | B1 | 11/2004 | Romppanen |
| 6,880,466 | B2 | 4/2005 | Carman |
| 6,898,887 | B1 | 5/2005 | Stratbucker |
| 6,957,602 | B1 | 10/2005 | Koenig et al. |
| 7,042,696 | B2 | 5/2006 | Smith et al. |
| 7,065,915 | B2 | 6/2006 | Chang |
| 7,075,770 | B1 | 7/2006 | Smith |
| 7,114,450 | B1 | 10/2006 | Chang |
| 7,143,539 | B2 | 12/2006 | Cerovic et al. |
| 7,143,699 | B2 | 12/2006 | Brock et al. |
| 7,218,501 | B2 | 5/2007 | Keely |
| 7,237,352 | B2 | 7/2007 | Keely et al. |
| 7,314,007 | B2 | 1/2008 | Su |
| 7,327,549 | B2 | 2/2008 | Smith et al. |
| 7,360,489 | B1 | 4/2008 | Han et al. |
| D570,948 | S | 6/2008 | Cerovic et al. |
| 7,409,912 | B2 | 8/2008 | Cerovic et al. |
| 7,412,975 | B2 | 8/2008 | Dillon, Jr. |
| 7,444,939 | B2 | 11/2008 | McNulty et al. |
| 7,444,940 | B2 | 11/2008 | Kapeles et al. |
| D602,109 | S | 10/2009 | Cerovic et al. |
| 7,640,839 | B2 | 1/2010 | McNulty, Jr. |
| 7,640,860 | B1 | 1/2010 | Glover |
| 7,673,411 | B1 | 3/2010 | Baldwin |
| 7,686,002 | B2 | 3/2010 | Andrews |
| 7,778,005 | B2 | 8/2010 | Saliga |
| 7,791,858 | B2 | 9/2010 | Hummel et al. |
| 7,856,929 | B2 | 12/2010 | Gavin et al. |
| 7,859,818 | B2 | 12/2010 | Kroll et al. |
| 7,900,388 | B2 | 3/2011 | Brundula et al. |
| 7,905,180 | B2 | 3/2011 | Chen |
| 7,950,176 | B1 | 5/2011 | Nemtyshkin |
| 7,950,329 | B1 | 5/2011 | Nemtyshkin et al. |
| 7,966,763 | B1 | 6/2011 | Schneider et al. |
| 7,984,676 | B1 | 7/2011 | Gavin et al. |
| 8,015,905 | B2 | 9/2011 | Park |
| 8,024,889 | B2 | 9/2011 | Bunker |
| 8,082,199 | B2 | 12/2011 | Kwok |
| D651,679 | S | 1/2012 | Klug et al. |
| 8,096,076 | B1 | 1/2012 | Cerovic |
| 8,141,493 | B1 | 3/2012 | Kuchman |
| 8,186,276 | B1 | 5/2012 | Olden et al. |
| 8,231,474 | B2 | 7/2012 | Stethem |
| 8,245,617 | B2 | 8/2012 | Martinez et al. |
| 8,261,666 | B2 | 9/2012 | Garg |
| 8,281,776 | B2 | 10/2012 | Kilevar et al. |
| 8,336,777 | B1 | 12/2012 | Pantuso et al. |
| 8,339,763 | B2 | 12/2012 | McNulty, Jr. |
| 8,441,771 | B2 | 5/2013 | Hinz et al. |
| 8,547,679 | B2 | 10/2013 | Gavin |
| 8,561,516 | B2 | 10/2013 | Martinez et al. |
| 8,601,928 | B2 | 12/2013 | Martinez et al. |
| 8,671,841 | B2 | 3/2014 | Raquin et al. |
| 8,695,578 | B2 | 4/2014 | Olden et al. |
| 8,677,675 | B2 | 5/2014 | Koch |
| 8,757,039 | B2 | 6/2014 | Martinez et al. |
| 8,857,305 | B1 | 10/2014 | Tseng |
| 8,881,654 | B2 | 11/2014 | Seecamp |
| 8,896,982 | B2 | 11/2014 | Beecher et al. |
| 8,899,139 | B2 | 12/2014 | Brill et al. |
| 9,025,304 | B2 | 5/2015 | Brundula et al. |
| D736,885 | S | 8/2015 | Swan et al. |
| 9,134,099 | B2 | 9/2015 | Tseng |
| 9,157,694 | B1 | 10/2015 | Tseng |
| 9,220,246 | B1 | 12/2015 | Roman |
| 9,255,765 | B2 | 2/2016 | Nelson |

(56) References Cited

U.S. PATENT DOCUMENTS

| | | | |
|---|---|---|---|
| 9,303,942 | B2 | 4/2016 | Sievers |
| 9,335,119 | B2 | 5/2016 | Werner |
| 9,414,578 | B2 | 8/2016 | Thornbrough |
| 9,435,619 | B1 | 9/2016 | Park |
| 9,441,896 | B2 | 9/2016 | Allan |
| 9,528,802 | B1 | 12/2016 | Markowitch |
| 9,581,417 | B2 | 2/2017 | Tseng |
| 9,638,498 | B2 | 5/2017 | Chang |
| D791,901 | S | 7/2017 | Swan et al. |
| 10,060,715 | B1 | 8/2018 | Davis |
| 10,107,599 | B2 | 10/2018 | Norris et al. |
| 10,288,388 | B1 | 5/2019 | Lavin |
| 10,551,152 | B2 | 2/2020 | Norris et al. |
| 10,634,461 | B2 | 4/2020 | Norris |
| 10,852,114 | B2 | 12/2020 | Norris |
| 2002/0134365 | A1 | 9/2002 | Gray |
| 2002/0170418 | A1 | 11/2002 | McNulty, Jr. et al. |
| 2002/0198072 | A1 | 12/2002 | LaSee |
| 2003/0106415 | A1 | 6/2003 | Smith |
| 2003/0165041 | A1 | 9/2003 | Stethem |
| 2003/0165042 | A1 | 9/2003 | Stethem |
| 2004/0245338 | A1 | 12/2004 | Poloniewicz |
| 2005/0166441 | A1 | 8/2005 | Mattox |
| 2006/0026884 | A1 | 2/2006 | Cerovic |
| 2006/0112574 | A1 | 6/2006 | Hodge et al. |
| 2006/0120009 | A1 | 6/2006 | Chudy, II |
| 2006/0254108 | A1 | 11/2006 | Park |
| 2007/0019358 | A1 | 1/2007 | Kroll |
| 2007/0070573 | A1 | 3/2007 | Nerheim et al. |
| 2007/0070574 | A1 | 3/2007 | Nerheim et al. |
| 2007/0079538 | A1 | 4/2007 | Smith et al. |
| 2007/0081292 | A1 | 4/2007 | Brundula et al. |
| 2007/0081293 | A1 | 4/2007 | Brundula et al. |
| 2007/0101893 | A1 | 5/2007 | Shalev et al. |
| 2007/0188972 | A1 | 8/2007 | Nerheim et al. |
| 2007/0264079 | A1 | 11/2007 | Martinez et al. |
| 2008/0204965 | A1 | 8/2008 | Brundula et al. |
| 2008/0259520 | A1 | 10/2008 | Brundula |
| 2009/0025597 | A1 | 1/2009 | Kapeles et al. |
| 2009/0084284 | A1 | 4/2009 | Martinez et al. |
| 2009/0323248 | A1 | 12/2009 | Brundula et al. |
| 2010/0071678 | A1 | 3/2010 | Allen |
| 2010/0126483 | A1 | 5/2010 | Makowski |
| 2010/0315755 | A1 | 12/2010 | Gavin |
| 2010/0315756 | A1 | 12/2010 | Gavin |
| 2011/0005373 | A1 | 1/2011 | Martinez et al. |
| 2011/0146133 | A1 | 6/2011 | Bunker |
| 2011/0271825 | A1 | 11/2011 | Howland |
| 2012/0019975 | A1 | 1/2012 | Hanchett et al. |
| 2012/0170167 | A1 | 7/2012 | Beechey |
| 2012/0210904 | A1 | 8/2012 | Merems |
| 2012/0257320 | A1 | 10/2012 | Brundula et al. |
| 2013/0180147 | A1 | 7/2013 | Lupher |
| 2013/0208392 | A1 | 8/2013 | Brundula et al. |
| 2014/0216290 | A1 | 8/2014 | Yee et al. |
| 2014/0331984 | A1 | 11/2014 | Brahler, II et al. |
| 2014/0334058 | A1 | 11/2014 | Galvan et al. |
| 2015/0075073 | A1 | 3/2015 | Sylvester |
| 2015/0168107 | A1 | 6/2015 | Tseng |
| 2015/0241180 | A1 | 8/2015 | Pruett |
| 2015/0276351 | A1 | 10/2015 | Pekarek et al. |
| 2015/0316345 | A1 | 11/2015 | Brahler, II et al. |
| 2016/0010949 | A1 | 1/2016 | Teetzel et al. |
| 2016/0161225 | A1 | 6/2016 | Searle et al. |
| 2016/0238350 | A1 | 8/2016 | Tseng |
| 2017/0029816 | A1 | 2/2017 | Swiderski |
| 2017/0160060 | A1 | 6/2017 | Purvis |
| 2017/0241751 | A1 | 8/2017 | Nerheim |
| 2017/0276461 | A1 | 9/2017 | Norris et al. |
| 2018/0003462 | A1 | 1/2018 | Chavez |
| 2018/0094908 | A1 | 4/2018 | Down et al. |
| 2018/0292172 | A1 | 10/2018 | Ehrlich |
| 2018/0335779 | A1 | 11/2018 | Fisher et al. |
| 2018/0372456 | A1 | 12/2018 | Norris |
| 2019/0113308 | A1 | 4/2019 | Norris |
| 2019/0186872 | A1 | 6/2019 | Salisbury et al. |
| 2019/0186873 | A1 | 6/2019 | Salisbury et al. |
| 2019/0271772 | A1 | 9/2019 | Nerheim et al. |
| 2020/0018583 | A1 | 1/2020 | Norris et al. |
| 2020/0072584 | A1 | 3/2020 | Ozanne |
| 2020/0096297 | A1 | 3/2020 | Norris |
| 2020/0109924 | A1 | 4/2020 | Goodchild |

FOREIGN PATENT DOCUMENTS

| | | | |
|---|---|---|---|
| DE | 3522661 | A1 | 1/1987 |
| GB | 2386673 | A | 9/2003 |
| JP | 2011/106748 | A | 6/2011 |
| RU | 2186492 | C2 | 8/2002 |
| RU | 2274823 | C1 | 4/2006 |
| RU | 2410625 | C2 | 1/2011 |

PROJECTILE LAUNCHING SYSTEMS WITH ANCHORS HAVING DISSIMILAR FLIGHT CHARACTERISTICS

PRIORITY

This is a continuation-in-part of U.S. patent application Ser. No. 17/179,341, filed Feb. 18, 2021, which is hereby incorporated herein by reference in its entirety.

BACKGROUND OF THE INVENTION

Field of the Invention

The present invention relates generally to less-than-lethal, ranged weapons systems to aid in impeding or subduing hostile or fleeing persons of interest.

Related Art

It has been recognized for some time that police and military personnel can benefit from the use of weapons and devices other than firearms to deal with some hostile situations. While firearms are necessary tools in law enforcement, they provide a level of force that is sometimes unwarranted. In many cases, law enforcement personnel may wish to deal with a situation without resorting to use of a firearm. It is generally accepted, however, that engaging in hand-to-hand combat is not a desirable alternative.

For at least these reasons, ranged engagement devices such as the TASER™ have been developed to provide an alternative approach to such situations. While such electrical muscular disruption ("EMD") weapons have been used with some success, debates continue as to whether such devices are as safe as claimed or are an appropriate level of force for many situations. Other ranged engagement solutions, such as mace or pepper spray, are very limited in range and are often criticized for the pain caused to subjects and the potential for such solutions to affect police or bystanders.

For at least these reasons, the present Applicant developed the commercially successful BOLAWRAP® brand launcher that can be used by police or law enforcement officers to safely and reliable restrain or temporarily impeded subjects. While the launchers developed by the present Applicant continue to enjoy widespread usage, efforts to improve the functionality of the launchers are ongoing.

SUMMARY OF THE INVENTION

In accordance with one aspect of the invention, a projectile deployment system is provided, including a projectile casing having a pair of sockets, each socket sized to carry one of a pair of anchors of an entangling projectile having a tether connecting the pair of anchors. Each of the pair of sockets can be angled equally relative to a centerline defined between the sockets. One or more pressure sources can each be capable of generating a pressure wave capable of expelling one or more of the anchors from the sockets to deploy the entangling projectile from the projectile casing toward a subject. A controller can be operable to activate one or both of the pressure sources. A sight can be oriented along a target line, the target line being offset relative to the centerline defined between the sockets such that when the anchors are deployed from the projectile casing they exhibit differing flight characteristics.

In accordance with another aspect of the technology, a projectile deployment system is provided, including a projectile casing having a pair of sockets, each socket sized to carry one of a pair of anchors of an entangling projectile having a tether connecting the pair of anchors. Each of the pair of sockets can be angled equally relative to a centerline defined between the sockets. One or more pressure sources can be capable of generating a pressure wave capable of expelling one or more of the anchors from the sockets to deploy the entangling projectile from the projectile casing toward a subject. A controller can be operable to activate one or both of the pressure sources. The projectile casing can define a target line orientable toward a subject, the target line being offset relative to the centerline defined between the sockets such that when the anchors are deployed from the projectile casing they exhibit differing flight characteristics.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1:
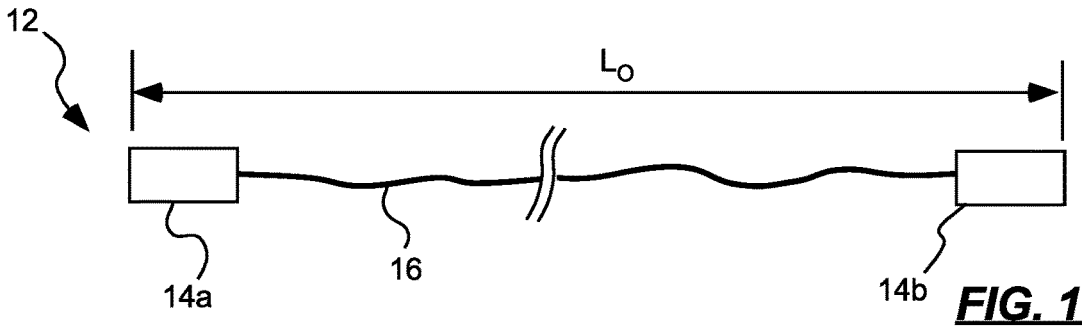
FIG. 1 is a top, bottom, front or rear view of an entangling projectile extended substantially to its full length in accordance with an embodiment of the invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "an anchor" can include one or more of such anchors, if the context dictates.

As used herein, the term "flight characteristic" is used to describe movement behavior of anchors that are launched and travel forwardly from a launching cartridge or casing so as to arrive at a targeted subject at differing times. By altering the relative flight characteristics of the anchors, the anchors are less likely to collide with one another when "wrapping" about the subject, as the anchors are at differing forward positions relative to the subject as they wrap about the subject. "Flight characteristic" can refer to a velocity of an anchor, a relative forward position of an anchor as it is discharged from a cartridge, an angle of trajectory relative to a cartridge, an aerodynamic drag (or drag coefficient) of an anchor, and/or an aerodynamic drag (or drag coefficient) of a portion of a projectile or a tether that affects a velocity of an anchor.

As used herein the term "drag coefficient" is to be understood to refer to a quality of an entangling projectile, anchor, tether or other object discussed herein that affects the fluid dynamic drag of such an object as it travels through air after being deployed from a launcher.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present invention. Such terms include, without limitation, "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure.

When a position of an anchor is discussed herein with relation to a position of the projectile casing, it is generally understood that the relation is to the frontmost portion of the casing: that is, the nearest portion of the casing to the anchor being discussed, after deployment of the anchor.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

INVENTION

The present technology relates generally to less-than-lethal weapons systems, sometimes referred to as ensnarement or entanglement systems, that can be effectively used as an aid in impeding the progress of or detaining aggressive or fleeing subjects. Devices in accordance with the present technology can be advantageously used to temporarily impede a subject's ability to walk, run, or use his or her arms in cases where law enforcement, security personnel or military personnel wish to detain a subject, but do not wish to use lethal or harmful force or to engage in close proximity hand-to-hand combat. The technology provides a manner by which the arms or legs of a subject can be temporarily tethered or bound, to the extent that the subject finds it difficult to continue moving in a normal fashion.

While the present technology can be directed at a range of portions of a subject's body, the following discussion will focus primarily on use of the technology to temporarily tether or bind a subject's legs. It is to be understood, however, that the present technology is not limited to this application. In some cases, multiple portions of the subject's body can be targeted, such as both the arms and the legs.

As shown generally in FIGS. 1-4, the present technology includes an entangling projectile 12 that can be deployed toward a subject's legs: when the projectile contacts the legs, the projectile wraps about the legs to thereby entangle or ensnare the subject. The projectile includes at least one flexible tether 16 and a pair of anchors or pellets 14*a*, 14*b*, coupled together by the tether. The anchors shown in FIGS. 1 through 4 are shown generically: as will be appreciated from the remaining figures, the anchors can include more sophisticated architecture where desired. By engaging a subject with the entangling projectile, the subject is temporarily rendered partially or fully incapacitated and thereby restricted in his or her ability to flee or attack. The entangling projectiles of the present technology are launched toward a subject (100 in FIGS. 3A-4) by a launcher. Portions of an exemplary launching cartridge or casing 44 for use with a suitable launcher are shown for example in FIGS. 5 and 6. While a functioning launcher will likely require more structure than that shown in the figures, one of ordinary skill in the art will readily appreciate the function and operation of the present components within an overall system. The cartridge or casing shown can be formed as a separate component, removable from the projectile launcher, or can be formed integrally therewith, or can form a portion of another component matable with the projectile launcher.

The energy source used to propel the entangling projectile can vary, but can include, as non-limiting examples, compressed gas, blank firearm cartridges, explosives/combustibles, mechanical springs, electro-magnetic assemblies, chemical compositions, etc.

Generally speaking, a launcher for use with the present entangling projectiles will launch the projectile toward a subject 100 at a relatively high rate of speed. Typically, the projectile can be deployed toward a subject from a distance of between about 6 feet and about 30 feet (1.8 to 9.1 meters), and engages the subject within less than about 0.5 seconds (traveling at about 400-600 ft/sec (122-183 m/s) at the muzzle). After being deployed from the launcher, the entangling projectile will wrap about the subject's legs a plurality of times, causing the subject to be temporarily unable to effectively move. As the entangling projectile can be launched from some distance, law enforcement personnel can maintain a safe distance from a subject, yet still be able to effectively and safely temporarily restrain, disable or impede the subject.

Figure 3A:
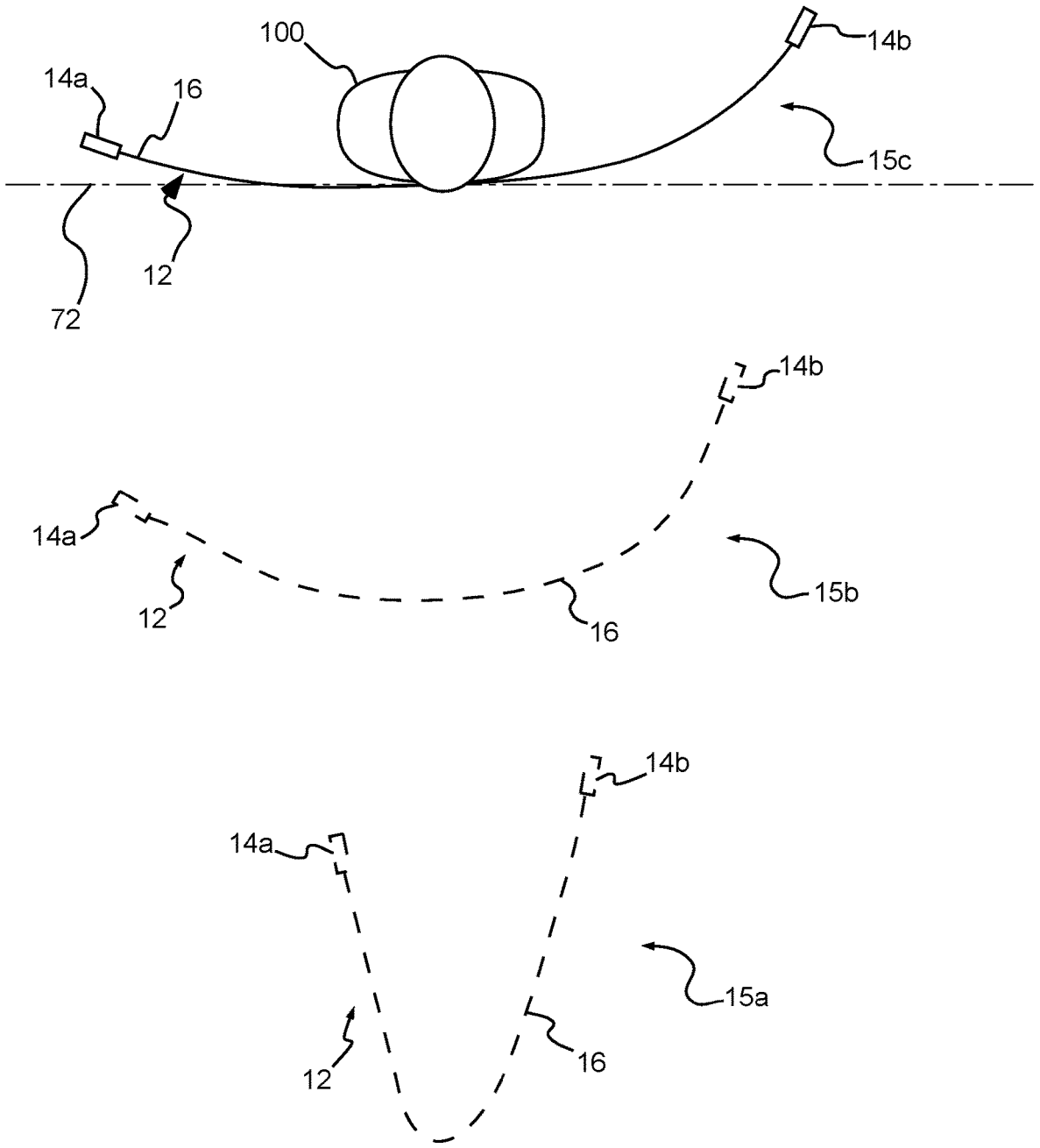
FIG. 3A is a top view of a subject toward which an entangling projectile has been launched, with an entangling projectile shown in incremental positions prior to engaging the subject.

Operation of the entangling projectile is shown generally in FIGS. 3A through 4: after being released by a launcher, the projectile 12 travels toward a subject 100. As the projectile travels toward the subject, pellets 14*a*, 14*b* travel away from one another. As the anchors travel away from one another, the tether 16 is pulled into an increasingly more taut configuration. Note that, as shown in FIG. 3A, the tether may not fully reach a taut configuration prior to engaging the subject. Once the projectile engages the subject (in the example shown in these figures, the subject's legs are engaged), the pellets and tether wrap about the subject and thereby temporarily entangle and/or disable the subject.

FIG. 1 illustrates the projectile 12 extended to its full length "Lo." In one embodiment, the overall length of the tether is much longer than the length of the anchors or pellets (Lai). The overall length can be on the order of seven feet (2.14 meters) or greater. The pellets can have a length "$L_{a1}$" (FIG. 2*a*) on the order of about 1.5 inches (3.81 cm), and a diameter "$D_a$" on the order of between about ⅛ of an inch and about ⅜ of an inch (0.32-0.95 cm). While differing embodiments of the technology can vary, it is generally desirable to maintain the pellets at a relatively small size to thereby limit the overall size requirements of the projectile casing that houses the pellets prior to deployment and to reduce the impact should a pellet contact the subject directly. In this manner, the technology can be provided in a lightweight, hand-held device.

Figure 3B:
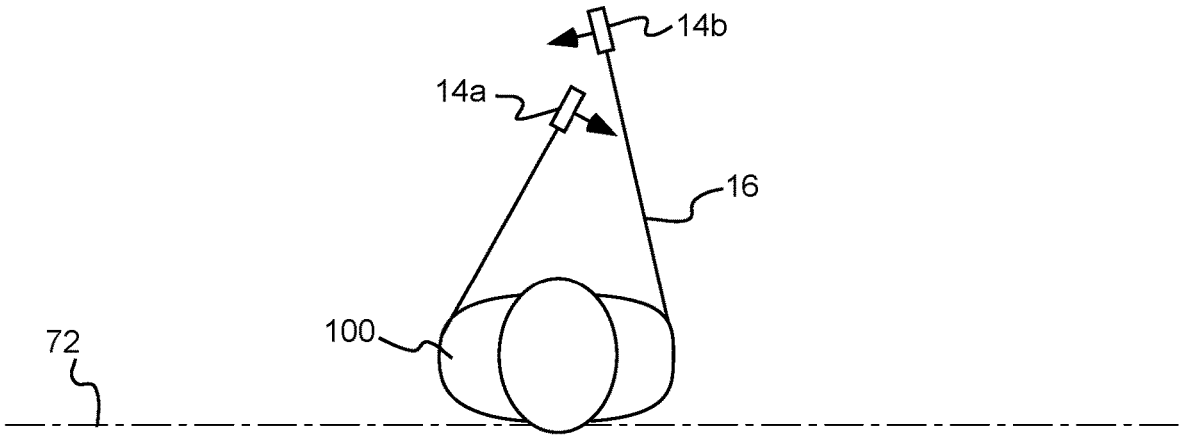
FIG. 3B is a top view of the subject and projectile of FIG. 3A, shown shortly after the entangling projectile engaged the subject.

FIGS. 3A and 3B illustrate an exemplary application of the present technology. These figures are provided to explain the basic function of the various components: it is to be understood that the relative sizes and positions of the various components in these figures may not be drawn to scale, nor may the relationship between the positions of the anchors and the tether be precisely shown. FIG. 3A illustrates a series of configurations/positions of the projectile 12 after it has been deployed from the launcher. As shown at reference 15*a*, the tether 16 generally trails behind the anchors 14*a*, 14*b* as the anchors move forwardly and apart. At the position shown at reference 15*b*, the anchors have advanced forwardly and further apart, and have pulled the tether into a configuration more closely approximating a taut configuration. The position shown at reference 15*c* is immediately prior to the tether 16 contacting the subject 100. After this point, the anchors will begin orbiting about the subject in smaller and smaller orbits until the projectile is completely wrapped about the subject. In previous wrapping scenarios, while a rare occurrence, it was at times the case that the anchors would collide with one another while wrapping about the subject. This could potentially result in a failed engagement. The present technology provides various features to avoid this result.

As will be appreciated from FIG. 3A, plane 72 represents a contact point at which the projectile 12 will engage the subject 100. In the case shown, anchor 14*b* will have traveled further from the launcher when it reaches plane 72 than will have anchor 14*a*. Due to this, to relative orbital trajectory the anchors travel will differ. This is shown schematically for example in FIG. 3B: anchor 14*a* is closer to the subject's body than is anchor 14*b* at the point where they coincide orbitally. Because of this, the anchors are positioned such that they cannot collide with another: they will travel easily past each other without contacting.

By providing systems and methods that result in the two anchors having differing flight characteristics, the time at which they break the plane of the subject is different: as such, the risk of a failed engagement is minimized. The present technology provides a variety of manners by which the anchors can exhibit differing flight characteristics. These differing flight characteristics allow the anchors to arrive at the subject at varying times, thereby reducing the risk of collision of the anchors as they orbit about the subject. The present technology can provide these advantages by modification of the anchors, the tether or the projectile casing.

Figure 5:
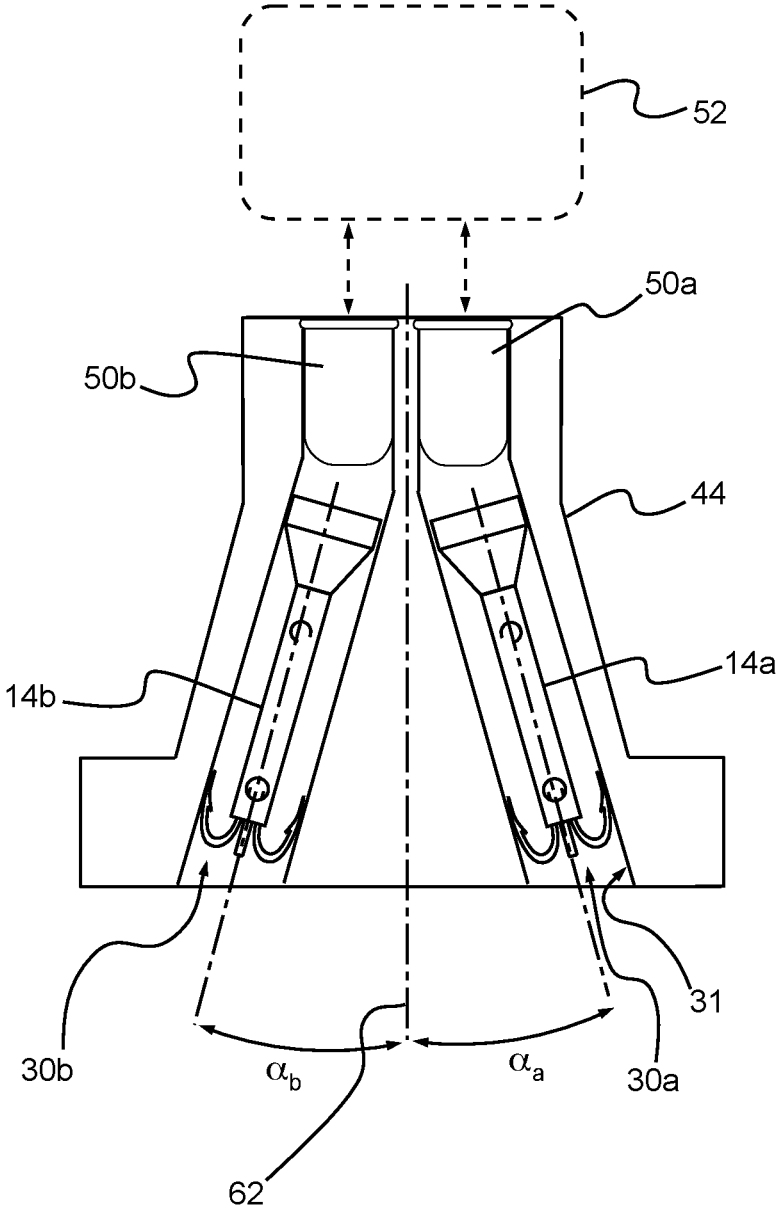
FIG. 5 is a top, schematic view of an exemplary launching cartridge or casing holding two anchors of an entangling projectile in accordance with embodiment of the invention.

Turning now to FIG. 5, an exemplary schematic figure of a projectile casing 44 illustrates one manner by which the anchors can be launched. The casing can include a pair of sockets 30*a*, 30*b*, each of which can be sized and shaped to carry one of the pair of anchors, 14*a*, 14*b*, respectively. The casing can carry at least one selectively activatable pressure source 50. While two pressure sources, 50*a*, 50*b*, are shown in the figures, many of the examples provided below can be actualized using a single pressure source that delivers a pressure to both of the sockets. The pressure source(s), once initiated, can be capable of expelling one or both of the anchors from the projectile casing toward a subject. One or more controllers 52 can be provided that can activate one or both of the pressure sources.

Figure 6:
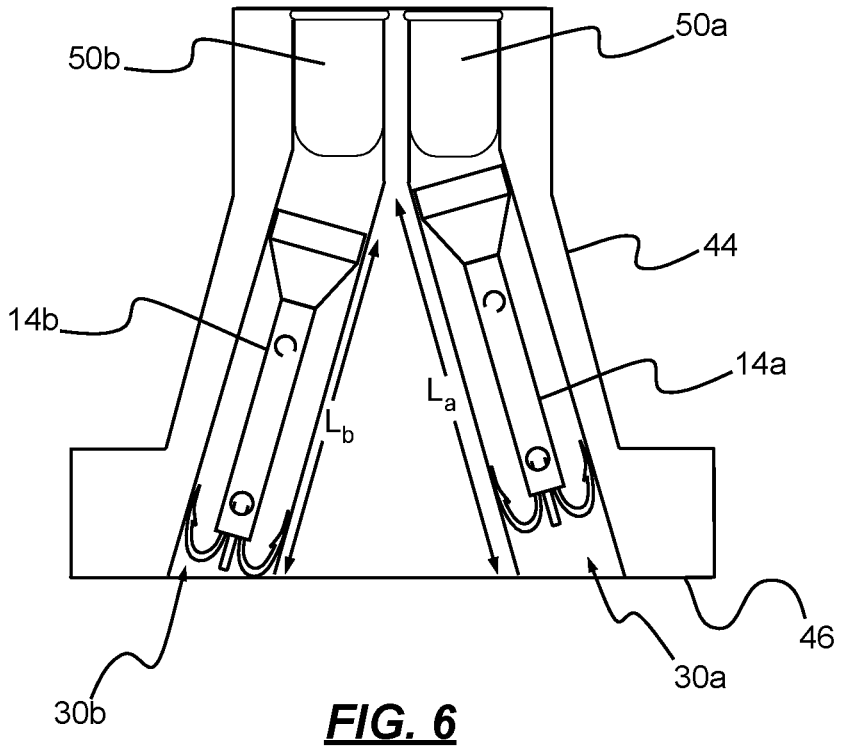
FIG. 6 is a top, schematic view of an exemplary launching cartridge or casing holding two anchors of an entangling projectile in accordance with another embodiment of the invention.
Figure 7:
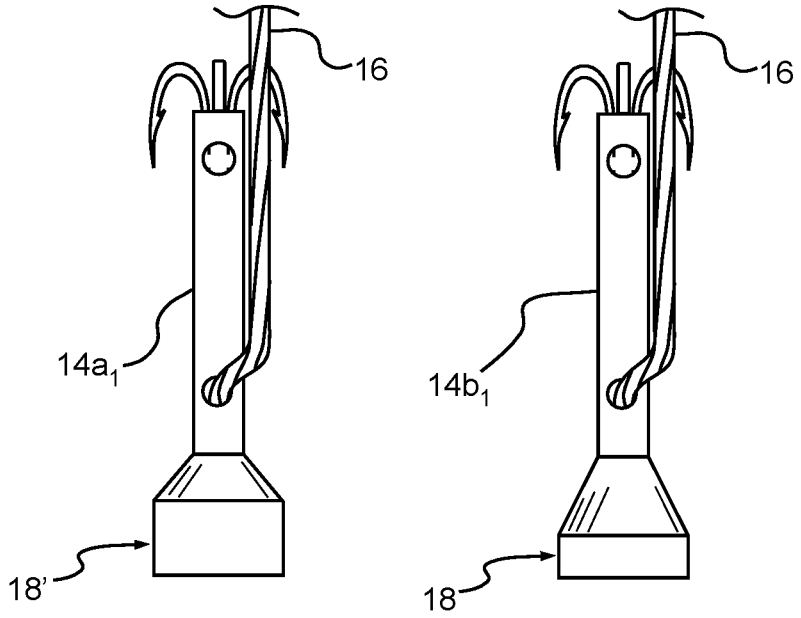
FIG. 7 is a partial view of an entangling projectile in accordance with an embodiment of the technology, with two anchors and portions of the tether shown.

The components of FIGS. 5 and 6 are shown schematically, as the physical nature of the pressure sources and controller can vary widely. In one example, the pressure sources 50*a*, 50*b* can be well-known cartridge blanks that contain powder but no slug. When initiated, they generate a significant pressure wave that propels the anchors 14*a*, 14*b* from the sockets 30*a*, 30*b*, respectively, with great force. In this basic example, the controller 52 can include a mechanical mechanism that forcibly strikes primers of the cartridge blanks and causes discharge. In other examples, the primers of the cartridge blanks can be electronically activated, in which case the controller will be electronic. In other examples, the pressure sources can include compressed gas cylinders, spring mechanisms, electronic actuators, electromagnetic assemblies, chemical compositions, etc.

Whichever pressure source and controller system are utilized, either or both the entangling projectile 12 or the projectile casing 44 can be configured such that the pair of anchors travel toward the subject with differing flight characteristics after being deployed from the projectile casing. With reference to the projectile casing 44, this can be accomplished in a number of manners. In one embodiment, shown by example in FIG. 6, the anchors 12*a*, 12*b* can be positioned prior to initiation at differing forward positions relative to a front 46 of the projectile casing 44. Length $L_b$ is shorter than length $L_a$. Assuming the anchors experience similar pressure waves at similar launch times, pellet 14*b* will travel slightly ahead of pellet 14*a* as they are deployed from the casing. This will result in the desired offset when eventually reaching the configuration shown in FIG. 3A.

In a similar arrangement, not shown explicitly in the figures, each socket can be fluidly coupled to an associated pressure source. A fluid distance from one anchor within a socket to a respective pressure source can be varied relative to a fluid distance from the other anchor within the other socket to the other respective pressure source. In other words, the distance that the pressure wave must travel before engaging the anchors can be varied. This can result in one anchor being deployed more quickly from the casing than the other. A similar result can be achieved by forming one socket with greater length than another socket: the shorter socket will likely not develop as great a pressure during deployment of the anchors, resulting in varied flight characteristics.

More generally speaking, the two sockets can be configured such they include asymmetric fluidic restrictions. For example, a fluidic distance can be varied, as described above, or differing internal restrictions can be included in the sockets, one or more choke points, etc. Each of these varying features can be introduced into the sockets to create a fluid differential that results in the differing flight characteristics.

In another example, pressure source 50*a* can be varied relative to pressure source 50*b*. For example, pressure source 50*a* can provide a greater magnitude pressure wave than 50*b*, resulting in the differing flight characteristics. When the cartridge blank is used in this example, the blank may carry more propellant, or a differing type of propellant. Also, differing propellant types can be selected that generate pressure waves more quickly or slowly, without regard to magnitude, to produce the same effect. In another example, controller 52 (which reference can include a single controller or two independent controllers) can initiate the pressure sources 50*a*, 50*b* at independent times. For example, in one embodiment, pressure source 50*b* can be initiated 0.1 to 8 ms (milliseconds) prior to pressure source 50*a*. In another embodiment, one pressure source can be initiated 2 to 3 ms prior to another pressure source. In another embodiment, one pressure source can be initiated 4 to 8 ms prior to another pressure source. Any suitable delay can be utilized, so long as the functional effect of staggering the anchors is achieved. This can be accomplished using either electronic controller(s) 52 or mechanical controller(s).

Figure 2A:
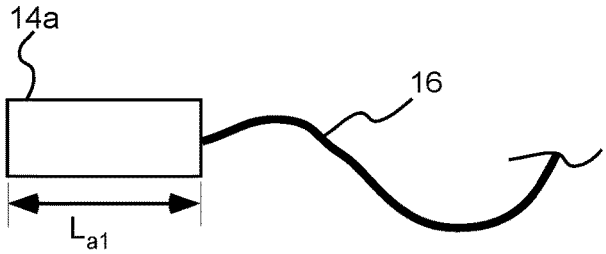
FIG. 2A is a side view of an anchor or pellet and a portion of a tether of the projectile of FIG. 1.
Figure 2B:
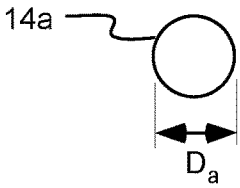
FIG. 2B is an end view of the anchor or pellet of FIG. 2A.

In another example, anchors 14*a*, 14*b* can be provided with substantially matching physical properties, such as outer diameter ($D_a$ in FIG. 2B, for example). However, an internal diameter of the sockets 30*a*, 30*b* can be varied. In other words, a frictional fit, or clearance, between the respective anchors and their sockets can be varied. In this manner, the relative movement within the sockets of the anchors can be varied: one anchor may travel more freely while another may be more restricted and not move as quickly. This differing clearance fit can also affect development of the pressure wave within the socket, again resulting in the differing flight characteristics. In addition, an inner surface finish of the sockets 30*a*, 30*b* can be varied. For example, one surface (31, in FIG. 5, for example) may be more or less smooth than another, which will affect the rate of travel of the anchor through the respective sockets.

As is illustrated in FIG. 5, the sockets 30*a* and 30*b* are generally angled outwardly relative to a forward directional orientation, or a target line, or in some aspects a centerline 62 of the casing 44. This results in the anchors travelling away from one another as they are deployed from the sockets and travel forwardly. The resulting forces cause the tether 16 to be pulled into a configuration that tends toward taut between the anchors prior to engaging the subject. In Applicant's conventional configuration, shown in FIG. 11A, launcher 110*a* is configured such that the respective angles, $\alpha_a$ and $\alpha_b$, are equal. That is, the respective anchors travel outwardly relative to the target line, in this case the centerline 64 of the casing 44 at equal angles.

In accordance with one aspect of the present technology, however, the angles can be varied relative to one another to produce the desired difference in flight characteristics of the anchors 14*a*, 14*b*. For example, angle $\alpha_a$ can be smaller than angle $\alpha_b$, resulting in anchor 14*a* traveling forwardly more directly than anchor 14*b*.

This can be accomplished in a number of manners. In the examples shown in FIGS. 11A and 11B, the system includes an aiming device, or sight 66 carried by launcher 110*a*, 110*b*. The sight can provide a manner by which a user can orient the launcher relative to a subject. In general, the sight is directed along a target line 68 between the launcher and a point of aim on a subject. The aiming device can include mechanical structure or markers, such as the so-called "iron sights" used in conventional firearms; or optical illumination, such as a laser sight, or devices that create a "hot spot" on the subject, visible through night vision googles or the like.

Figure 4A:
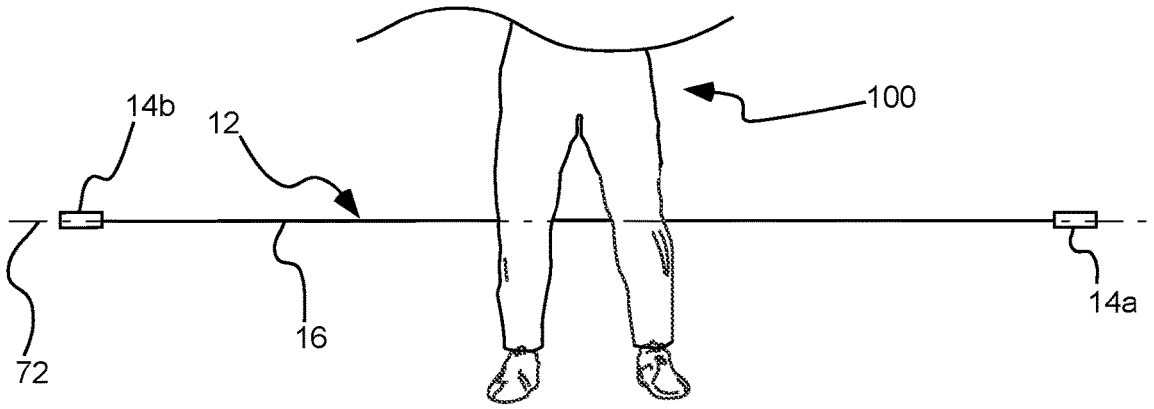
FIG. 4A is a front view of a portion of the subject in accordance with an embodiment of the invention, shown immediately prior to the entangling projectile engaging the subject's legs.
Figure 11A:
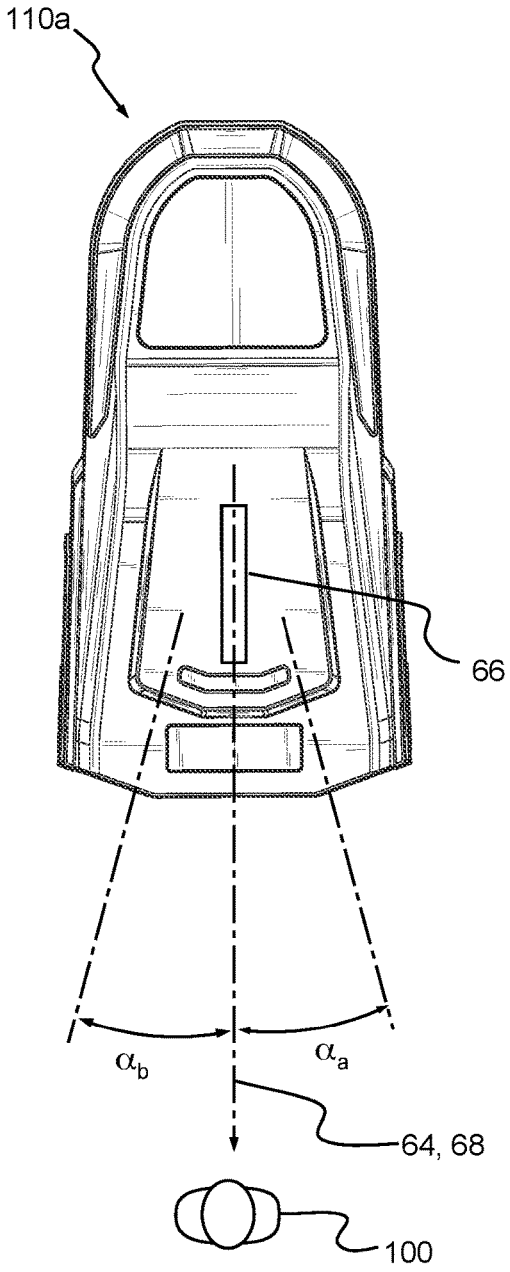
FIG. 11A is a top view of an exemplary projectile launcher.

Whichever configuration of sighting mechanic is utilized, the sight 66 allows a user to intuitively and properly aim the launcher at a subject along the target line 68. In the example of FIG. 11A, the sight 66 is aligned to coincide with the centerline of the launcher. As such, the centerline 64 defined between the two sockets and the target line 68 coincide with one another: the launcher is targeted along the centerline of the launcher and the centerline defined between the two sockets. As the angles $\alpha_a$ and $\alpha_b$, are equal in this example, the resulting launch directs the projectile toward the subject 100 (shown in this figure very much reduced in scale for explanatory purposes) so that a center of the tether contacts the subject, with substantially equal lengths of tether extending to both sides of the subject, as illustrated in FIG. 4A.

Figure 11B:
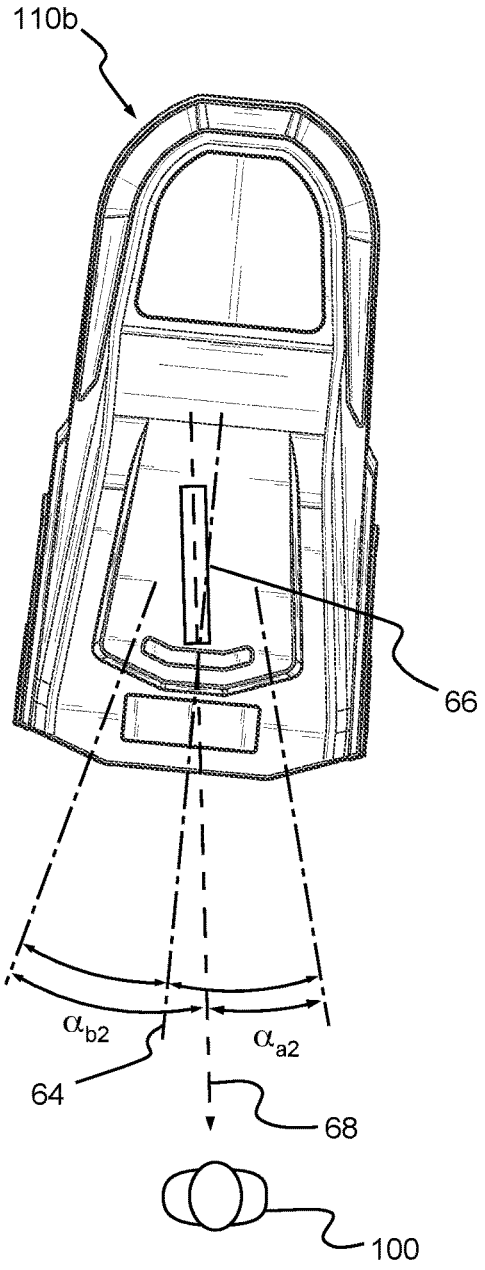
FIG. 11B is a top view of a projectile launcher in accordance with an aspect of the technology.

In one embodiment, however, shown in FIG. 11B, the system can be configured such that the angles $\alpha_a$ and $\alpha_b$, are unequal, to create differing flight characteristics for each anchor or pellet. In this example, the sight 66 is purposely misaligned relative to, or offset with, a centerline 64 defined between the two sockets of the launcher 110*b*. As will be appreciated from the figure, angle $\alpha_{b2}$ is greater than angle $\alpha_{a2}$. A user will intuitively manipulate the launcher such that sight 66 directs the target line 68 toward an aiming point on the subject 100 (shown in this figure very much reduced in scale for explanatory purposes). When doing so, however, the centerline 64 between the sockets will be offset slightly away from the aiming point on the subject.

Figure 4B:
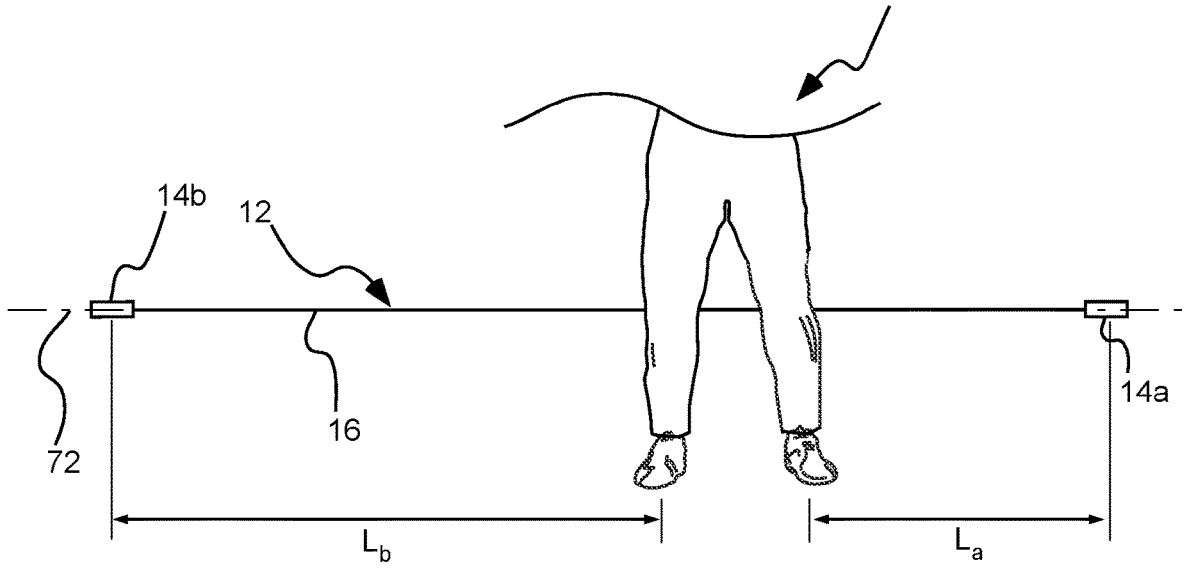
FIG. 4B is a front view of a portion of the subject in accordance with an embodiment of the invention, shown immediately prior to the entangling projectile engaging the subject's legs in accordance with another embodiment.

Thus, when the launcher 110*b* of FIG. 11B is actuated, the pellets or anchors will travel toward the subject at unequal angles relative to the target line 68. As shown in FIG. 4B, upon reaching the subject 100, one length $L_b$ of tether aside the subject is longer than an opposing length $L_a$ of tether 16. The anchors or pellets are thus provided with differing flight characteristics and will not be inclined to collide as they wrap about the subject.

Figure 12:
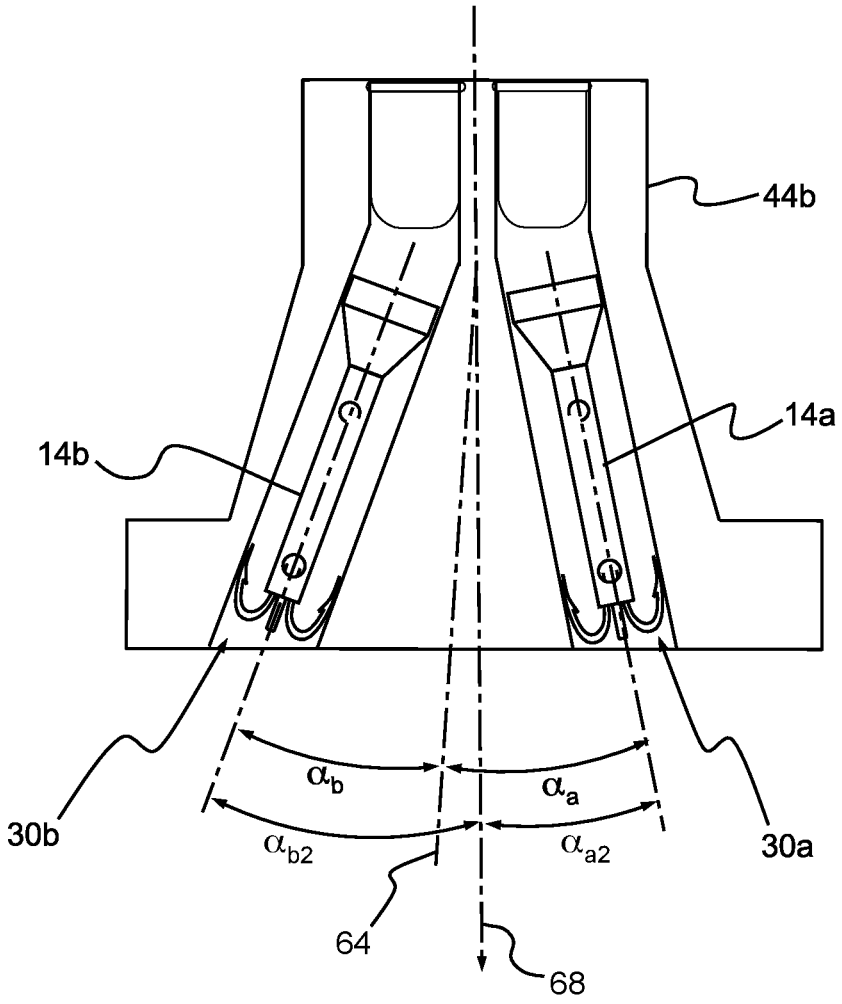
FIG. 12 is a top, schematic view of an exemplary launching cartridge or casing holding two anchors of an entangling projectile in accordance with another embodiment of the technology.

FIG. 12 illustrates another manner of configuring the launcher to impart differing flight characteristics to the anchors. In this example, casing 44*b* includes sockets 30*a*, 30*b* oriented such that a centerline 64 is defined between the sockets. Thus, in this example, angle $\alpha_b$ is equal to angle $\alpha_a$. The sockets, however, are formed in or oriented relative to the casing or cartridge 44*b* such the target line 68 orientable toward a subject is offset relative to the centerline 64. In this manner, when the anchors are deployed from the projectile casing they exhibit differing flight characteristics.

The examples shown in FIGS. 11B and 12 produce essentially the same effect: the anchors or pellets are propelled from a launcher toward a subject along a target line. The anchors, however, are not symmetrically arranged relative to the target line, and so are discharged with differing flight characteristics that create the arrangement shown in FIG. 4B immediately prior to impact with the subject, which lessens the risks of the anchors colliding as they wrap about the subject.

While the figures illustrate arrangements in which the target line is angled relative to the centerline between the anchors, in some embodiments the target line is spaced from the centerline, but the two are substantially parallel. When the two are angled, the angle can vary from between about 1 degree and about 15 degrees. In one embodiment, the target line is angled relative to the centerline defined between the sockets at an acute, non-zero angle.

FIGS. 7 through 10 illustrate further embodiments of the technology in which physical characteristics of various components of the entangling projectile are varied to produce differing flight characteristics in the anchors. These examples are also shown schematically, and may not be to scale or may not represent the physical differences between the anchors in accurate detail. In each of the examples shown, the anchors include a base portion that is generally larger in diameter than a remainder of anchor. This is generally the portion of the anchor against which the pressure wave applies force to the anchor. In the example shown in FIG. 7, the base portion 18' of anchor $\mathbf{14}a_1$ is formed with a larger volume than a corresponding feature of anchor $\mathbf{14}b_1$. Assuming the anchors are formed from the same material, this results in anchor $\mathbf{14}a_1$ having a greater mass than $\mathbf{14}b_1$, and likely thereby having a slower forward velocity after being deployed from the casing. The increased mass or size of the base portion of anchor $\mathbf{14}a_1$ may also affect the rate at which the anchor travels through a socket, and through air after being deployed from the socket.

Figure 8:
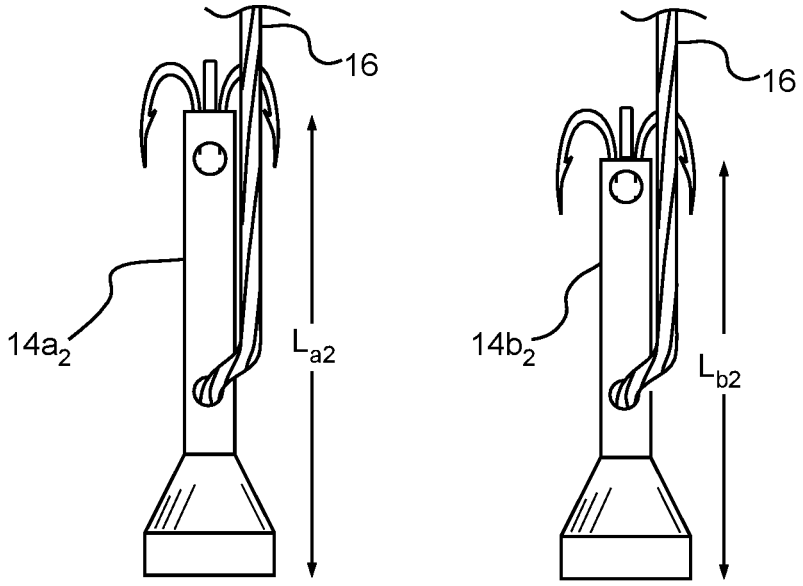
FIG. 8 is a partial view of an entangling projectile in accordance with another embodiment of the technology, with two anchors and portions of the tether shown.

In the example shown in FIG. 8, anchor $\mathbf{14}b_2$ includes a similar configuration to anchor $\mathbf{14}a_2$, but is smaller in length, as seen by a comparison of lengths $L_{a2}$ and $L_{b2}$. As such, anchor $\mathbf{14}b_2$ will likely have a greater forward velocity after being deployed from the casing.

Figure 9:
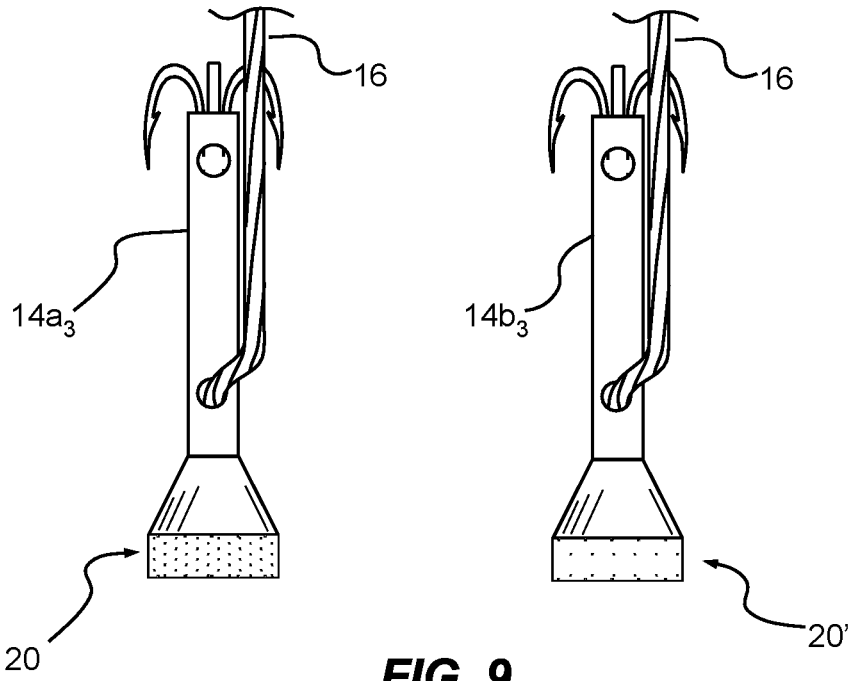
FIG. 9 is a partial view of an entangling projectile in accordance with another embodiment of the technology, with two anchors and portions of the tether shown.

In the example shown in FIG. 9, an outer surface 20 of the base of anchor $\mathbf{14}a_3$ is formed with a different surface finish than outer surface 20' of the base of anchor $\mathbf{14}b_3$. This difference can affect the flight characteristics of the pellet in a number of manners. Firstly, the different surface treatments can produce a differing frictional engagement with an inner surface of the sockets, which can affect the speed with which the anchor travels along the socket. In addition, changes can be made to the surface areas 20, 20' that affect the coefficient of drag of the anchors. This can slow the velocity of the anchor as it travels through the air, as well as introduce desired changes to the trajectory of the anchor as it travels through the air.

In addition to the physical characteristics shown in the figures, the anchors can also be formed from differing material, which can affect the relative mass of the anchors. These changes in material can also affect the coefficient of drag of the anchors and the coefficient of friction relative to the inner surfaces of the sockets. In addition, the outer base surface of one of the anchors can be formed with a slightly larger diameter (e.g., $D_a$ in FIG. 2B) than the other anchor. This can affect the rate at which the anchor travels along its respective socket.

In addition to the specific examples provided, other variations or treatments can be incorporated into either the projectile casing or anchors to create differing flight characteristics. Also, features like those described above can be incorporated into both the anchors and the casing. That is, both physical characteristics of the sockets 30*a*, 30*b* of the casing 44 may vary relative to one another and physical characteristics of the anchors 14*a*, 14*b* may vary relative to one another, or both.

Figure 10:
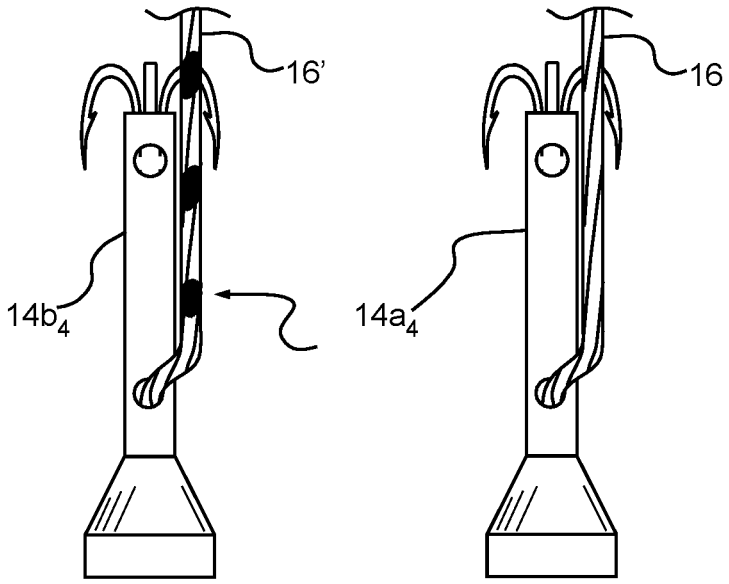
FIG. 10 is a partial view of an entangling projectile in accordance with another embodiment of the technology, with two anchors and portions of the tether shown.

FIG. 10 illustrates another aspect of the technology in which a section of the tether adjacent each of the anchors differs from each other. In the example shown, section 16' of the tether adjacent anchor $\mathbf{14}b_4$ differs from the corresponding section of anchor $\mathbf{14}a_4$. The section can include, for example, surface finish differences, additional weight, etc. In addition, a location at which the tether is attached to the anchor can be varied. Also, the manner in which the tether is wound adjacent each anchor can be varied, as well as the storage arrangement adjacent each tether within the casing or housing. Each of these features or modifications can alter a flight characteristic of a respective anchor relative to the other anchor.

In addition to the structure outlined above, the present technology also provides various methods of manufacturing, configuring, deploying and loading entangling projectiles and their associated launchers and cartridges. In one specific example, a method is provided of deploying an entangling projectile carried by an entangling projectile launcher, the entangling projectile launcher including a pair of sockets, with one each of a pair of anchors carried in each socket and a tether connecting the anchors. The method can include initiating one or more selectively activatable pressure sources to thereby propel each of the anchors forwardly within each respective socket such that the pair of anchors are deployed from the launcher with differing flight characteristics.

The method can further include initiating a pair of pressure sources, each associated with one of the pair of anchors, at differing times.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiment(s) of the invention. It will be apparent to those of ordinary skill in the art that numerous modifications can be made without departing from the principles and concepts of the invention as set forth in the examples.

The invention claimed is:

1. A projectile deployment system, comprising:

a projectile casing, including:

a pair of sockets, each socket sized to carry one of a pair of anchors of an entangling projectile having a tether connecting the pair of anchors;

each of the pair of sockets being angled equally relative to a centerline defined between the sockets;

at least one pressure source, capable of generating a pressure wave capable of expelling at least one of the anchors from the sockets to deploy the entangling projectile from the projectile casing toward a subject;

a controller, operable to activate the at least one pressure source; and a sight, the sight being oriented along a target line, the target line being offset relative to the centerline defined between the sockets such that the anchors are deployed from the projectile casing at differing angles of trajectory relative to the target line.

2. The system of claim 1, wherein the target line is angled relative to the centerline defined between the sockets.

3. The system of claim 2, wherein the target line is angled relative to the centerline defined between the sockets at an angle between about 1 degree and about 15 degrees.

4. The system of claim 2, wherein the target line is angled relative to the centerline defined between the sockets at an acute, non-zero angle.

5. The system of claim 1, wherein the sight includes mechanical markers.

6. The system of claim 1, wherein the sight includes a laser sight.

7. The system of claim 1, wherein the projectile casing is carried by a projectile launcher, and wherein the sight is carried by the projectile launcher.

8. The system of claim 7, wherein the projectile launcher includes a centerline, and wherein the centerline of the projectile launcher corresponds to the centerline defined between the sockets.

9. A projectile deployment system, comprising:

a projectile casing, including:

a pair of sockets, each socket sized to carry one of a pair of anchors of an entangling projectile having a tether connecting the pair of anchors;

each of the pair of sockets being angled equally relative to a centerline defined between the sockets;

at least one pressure source, capable of generating a pressure wave capable of expelling one or more of the anchors from the sockets to deploy the entangling projectile from the projectile casing toward a subject; and a controller, operable to activate the at least one pressure source;

the projectile casing defining a target line orientable toward a subject, the target line being offset relative to the centerline defined between the sockets such that the anchors are deployed from the projectile at differing angles of trajectory relative to the target line.

10. The system of claim 9, wherein the target line is angled relative to the centerline defined between the sockets.

11. The system of claim 10, wherein the target line is angled relative to the centerline defined between the sockets at an angle between about 1 degree and about 15 degrees.

12. The system of claim 10, wherein the target line is angled relative to the centerline defined between the sockets at an acute, non-zero angle.

13. The system of claim 9, wherein the projectile casing is carried by a projectile launcher, and wherein a centerline of the projectile casing corresponds to the target line.

* * * * *